United States Patent [19]

Ebihara et al.

[11] Patent Number: 4,999,087

[45] Date of Patent: Mar. 12, 1991

[54] TWIN WIRE FORMING APPARATUS WITH POSITIVE PRESSURE FOILS

[75] Inventors: Masafumi Ebihara, Mihara; Takeshi Akitomo, Hiroshima; Minoru Nomura, Tokyo, all of Japan

[73] Assignee: Research Association for Pulp and Paper Technology, Tokyo, Japan

[21] Appl. No.: 364,531

[22] Filed: Jun. 12, 1989

Related U.S. Application Data

[63] Continuation of Ser. No. 110,584, Oct. 19, 1987, abandoned, which is a continuation of Ser. No. 783,434, Oct. 3, 1985, abandoned.

[30] Foreign Application Priority Data

Oct. 3, 1984 [JP] Japan ..... 59-207885

[51] Int. Cl.[5] ..... D21F 1/00; D21F 1/54

[52] U.S. Cl. ..... 162/301; 162/300; 162/352

[58] Field of Search ..... 162/300, 301, 303, 348, 162/352

[56] References Cited

U.S. PATENT DOCUMENTS

| | | | |
|---|---|---|---|
| 2,141,393 | 12/1938 | Hill | 162/352 |
| 3,489,644 | 1/1970 | Rhine | 162/352 |
| 3,573,159 | 3/1971 | Sepall | 162/208 |
| 3,810,817 | 5/1974 | Arledter | 162/301 |
| 3,944,464 | 3/1976 | Means | 162/301 |
| 4,306,934 | 12/1981 | Seppanen | 162/300 |
| 4,447,296 | 5/1984 | Cruse | 162/352 |

FOREIGN PATENT DOCUMENTS

| | | | |
|---|---|---|---|
| 3138133 | 3/1983 | Fed. Rep. of Germany | 162/301 |
| 10709 | 1/1978 | Japan | 162/301 |
| 1075898 | 4/1986 | Japan | 162/348 |
| 1119796 | 6/1986 | Japan | 162/352 |

*Primary Examiner*—Karen M. Hastings

[57] ABSTRACT

A paper web forming apparatus essentially comprising two wires which move together with stock which is held therebetween and a plurality of wire supporting members for supporting the wires, each of the wire supporting members forming a wedge-shaped space, as defined between the wire surface and the wire supporting member, wherein the wedge-shaped space is so designed that the width as measured therebetween decreases as seen in the direction of movement of the wires.

2 Claims, 4 Drawing Sheets

TWIN WIRE FORMING APPARATUS WITH POSITIVE PRESSURE FOILS

This application is a continuation, of application Ser. No. 07/110,584 filed on 10/19/87, now abandoned, which in turn was a continuation of application Ser. No. 783,434 filed 10/3/85, now abandoned.

BACKGROUND OF THE INVENTION (i) Field of the Invention

The present invention relates to a paper web forming apparatus and more particularly to a paper web forming apparatus of the type employable, for instance, for a double wire type wire part which is designed to include a section where two wires are adapted to move in the distance from a supporting roll to the next supporting roll while raw material (stock) is held therebetween and a single wire type wire part which is so designed that two wires can move in parallel with one another with the aid of top wire arranged additionally.

(ii) Description of the Prior Art

Wire parts of FOURDRINIER paper machines are generally classified into two types, that is, single wire type and double wire type. This FOURDRINIER paper machine is so constructed that raw material including fiber slurry and filler at a predetermined consistency is caused to uniformly disperse in a head box and thus uniformly dispersed stock material is quickly transferred to a wire part at which drainage is achieved to produce, a product in the form of paper web (wet paper). It appears that in said machine basic formation of the paper web (flock recognizable due to non-uniformity in entangling and distributing of fibers in paper web) is dependent on performance of the head box and an effect on the wire part is recognized only to the foremost part thereof at which dewatering is initiated. In practice, all the conventional wire parts are designed on the basis of the above-mentioned concept. Thus, wire part components or the like disposed for the purpose of better formation (dispersion of fibers) can not be looked for in the practical machine.

To facilitate understanding of the present invention it will be helpful that the typical wire types will be described below with reference to FIGS. 4 to 11.

First, FIG. 4 is a schematic side view illustrating an example of the single wire type. In the drawing reference numeral 1 designates a head box from which uniformly dispersed raw material 2 is injected. Thus injected raw material is then transferred on the wire 4 which are supported by means of a forming board 3. During movement of raw material on the wire in the direction as identified by an arrow mark in the drawing raw material is subjected to dewatering with the aid of a plurality of foils 5, table rolls 6, vacuum foil boxes 8, suction boxes 9 and a suction couch roll 10. A deflector 7 serves to scrape off white water which drained by means of the table rolls 6, while the wire is held in the horizontal posture.

Consistency of raw material is normally determined in the range of 0.5 to 1% at the outlet of the head box 1 and it increases to a level of 3 to 6% when raw material reaches the suction box 9. After it moves past the suction couch roll 10, it is dehydrated to a level of about 20% whereby it becomes a wet paper web. The produced wet paper web is taken out from and change the wires 4 under the effect of suction which is generated by means of a suction pickup roll 11 and it is then transferred on a felt 12.

FIG. 5 is an enlarged side view of the foils 5 which illustrates change of pressure exerted on raw material held on the wire 4 by the foils 5 and FIG. 6 is an enlarged side view of the table rolls 6 which illustrates change of pressure exerted on raw material held on the wire 4 varies by table rolls 6.

As is apparent from FIG. 4, the vacuum foil box 8 is so constructed that a plurality of foils are arranged one after another on the upper surface of the box which is evacuated to a level of comparatively low vacuum whereby dewatering enhanced. The suction box 9 is so designed that a perforated plates with a number of elongated holes or round holes formed thereon in plural rows are placed on the upper surface of the box whereby forcible dewatering is achieved under a high intensity of vacuum atmosphere. Next, the suction couch roll 10 is so designed that a suction box is disposed inside the perforated cell whereby powerful dewatering is achieved.

FIG. 7 is a schematic side view of an example of the double wire type that is so called gap type and FIG. 8 is a fragmental side view of the apparatus in FIG. 7, shown in an enlarged scale. Raw material 22 is injected from the head box 21 and it is then caused to move upwardly while it is clamped between both of the wires 23 and 24. Dewatering is achieved under the effect of pressure which is generated by means of a plurality of forming shoes 25 in the presence of wire tension and white water which appears as a result of dewatering is removed by scraping operation of the forming shoes 25 on the inside of the apparatus as well as by centrifugal force on the outside of the same. Thus dewatered raw material is transferred to the felt via the suction box 26 having the curved perforated plates and the suction couch roll 27.

FIG. 9 is a schemtic side view illustrating another example of the gap system double wire type and FIG. 10 is a fragmental side view of the apparatus in FIG. 9, shown in an enlarged scale. In the illustrated example a plurality of dewatering blades 31 are alternately arranged on both the sides of the wires.

FIG. 11 is a schematic side view illustrating an example of the double wire type that is so called roll type. In the illustrated example raw material is dewatered under the effect of pressure which is generated by tension of the wires partially wound about the suction roll 27 as well as suction force which is generated by means of the suction roll. Incidentally, in some case the roll is designed in the solid structure. In addition to this various types are practically employed but basic concept is based on a combination of the above-mentioned types or its modification or improvement.

Description will be made below as to devices and components used for the wire part to have an effect on raw material (hereinafter referred to simply as components), excluding the forming board and the deflector. Naturally, each of the components is designed and constructed for the purpose of carrying out dewatering under the influence of vacuum or pressure in such a manner that their foremost end comes in contact with the wires with the exception of rolls.

Among the above-mentioned components the forming board 3, the table rolls 6 and the foils 5 are helpful for the purpose to improve formation of the paper web when they are used with reduced dewatering force, as long as consistency of raw material is not so rich compared with that in the head box (normally in the range of 0.5 to 1%). The manner of utilizing them is determined in accordance with the extent that the wire part for which they are in use exhibits its inherent performances and therefore it has very few effect on production of paper. With respect to the double wire type it is found that relatively good formation is achieved compared with the single wire type. However, even in the case of the double wire type the formation becomes deteriorated as consistency increases. For this reason, any practical paper making machine is operated under the operative condition relative to consistency of fibers not in excess of 1%.

The essential reason why no improved formation can be obtained by means of the wire part and thereby consistency of raw material in the head box can not be increased consists in function of dewatering as mentioned below which is carried out by means of the components supporting the wires while raw material moves together with the wires. As is well known, raw material held on the wire or between the two is subjected to dewatering as it moves, resulting in increased consistency and reduced fluidity. Raw material located in the area in the vicinity of the wire surface is increasingly concentrated under the influence of dewatering until a fiber mat is formed. Although the components serve to support the wire function to disperse the raw material, they fail to do so as fludity of raw material decreases. As a result, only little accumulation of dispersion effect can be expected with them.

Further, when function other than dewatering is imparted to raw material at the step where forming of fiber mat proceeds, there is a danger of damaging or injuring the fiber mat which is being formed. In practice, it is reported that the paper web having bad formation with grain-shaped flock extended over the whole area of the product is produced when the machine is operated under the condition of comparatively high consistency (in the range of 1 to 1.5%) in accordance with the double wire type while the components constituting the wire part are adjusted to exhibit a high intensity of function thereof. In this case such a pattern that thus produced fiber mat is torn in pieces is recognized with respect to the flock appearing on the fiber mat.

In view of the above-mentioned facts it is generally considered that characterizing features of formation dependent on the structure of the wire part to some extent but formation is fundamentally determined by performance of the head box without remarkable improvement in the area of the wire part.

To obviate the foregoing problem consistency of raw material particularly in the head box may be raised up to a higher level, for instance, in the range of 2 to 3%. This level of consistency of raw material corresponds to consistency of the same as measured at the position located before the suction box or that as measured at the position located in the proximity of the suction box, when the single wire type is employed for the machine. This means that dispersion function to be achieved for raw material in the area just before the suction box is dependent only on dispersion function which is achieved in the head box. However, since raw material having a higher consistency as mentioned above has a high level of viscosity compared with raw material having a consistency lower than 1% and moreover repeated flocking (representing such a state that fibers become granular due to an occurrence of entangling) lasts for a very short period of time (for instance, on the order of 1/100 second), it is difficult to develop a head box which can maintain dispersion of raw material properly until the latter is processed to a product in the form of paper and this is the reason why raw material having a higher level of concentration can not be used.

SUMMARY OF THE INVENTION

Hence, the present invention has been made with the foregoing background in mind and its object resides in providing a paper web forming apparatus which assures that dispersion capability of the wire part is remarkably improved to such an extent that can not be expected with the conventional apparatus and moreover it can be properly operated at a consistency of raw material in the range of 3 to 4% in the head box.

To accomplish the above object there is proposed according to the invention a paper forming apparatus comprising two wires adapted to move together with raw material which is held therebetween and wire supporting members for supporting the wires at the both sides of the wires, each of the wire supporting members forming a wedge-shaped space as defined between the wire surface and the wire supporting member, wherein the wedge-shaped space is so formed that the width as measured therebetween decreases as seen in the direction of movement of the wires.

In a preferred embodiment of the invention raw material which has moved into the formation improving zone and the two wires are pushed in relative to the wire line by a very short distance in the area where the wire supporting members come in contact with the wires. Pressure is generated in raw material held between the two wires under the effect of the above-mentioned pushing-in and wire tension and thereby white water is oozed out of raw material so as to allow the wires to become wetted with white water. After the surface of the wire supporting members is wetted with the oozed white water, the latter is caused to flow back into the raw material by the action of the wedge-shaped space and it is then oozed out of raw material on the opposite side to move further together with the wires.

Said oozed out actions are carried out alternately, in the number of plural times, to the raw material from both sides of the wires by the wire supporting members.

Thus, the better formation is formed, by the high frequent vibration which is added the raw material held between the two wires by the white water passed through the wires.

Other objects, features and advantages of the invention will become readily apparent from reading of the following description which has been prepared in conjunction with the accompanying drawings.

BRIEF DESCRIPTION OF THE DRAWINGS

The accompanying drawings will be briefly described below.

DETAILED DESCRIPTION OF THE INVENTION

Now, the present invention will be described in a greater detail hereunder with reference to the accompanying drawings which illustrate preferred embodiments thereof.

Figure 1:
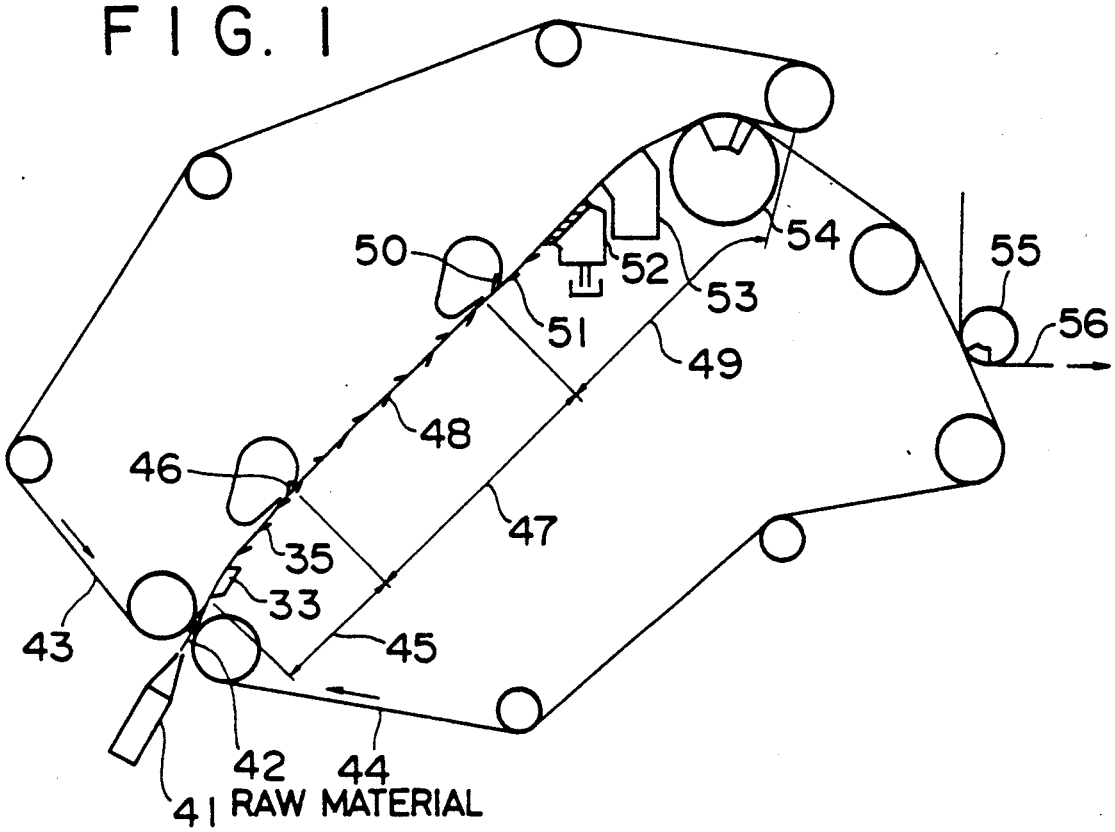
FIG. 1 is a sectional side view of a paper web forming apparatus in accordance with an embodiment of the invention.
Figure 2:
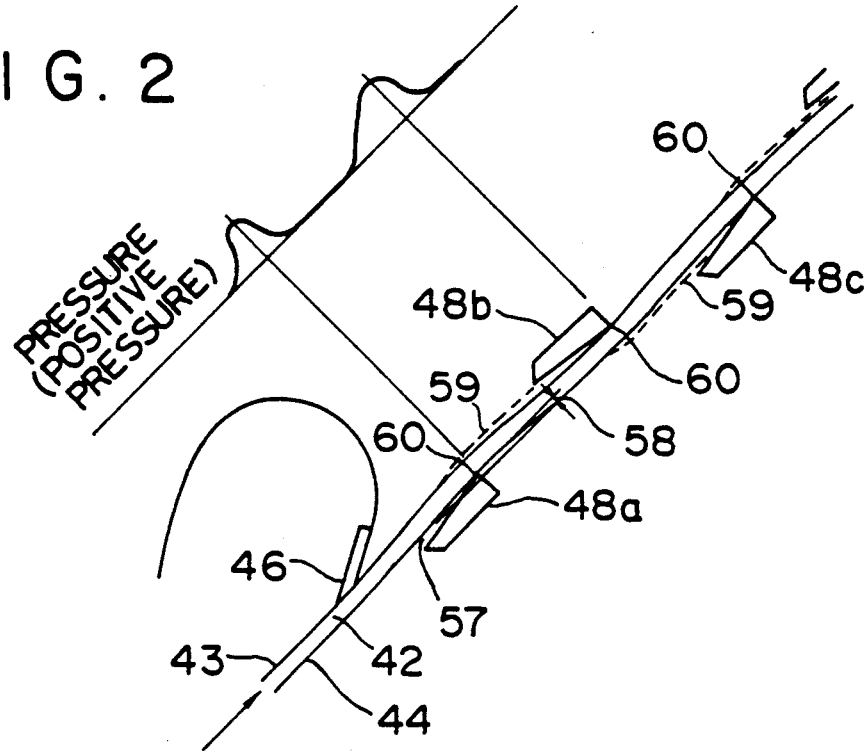
FIG. 2 is a fragmental side view of the apparatus in FIG. 2, shown in an enlarged scale.
Figure 3:
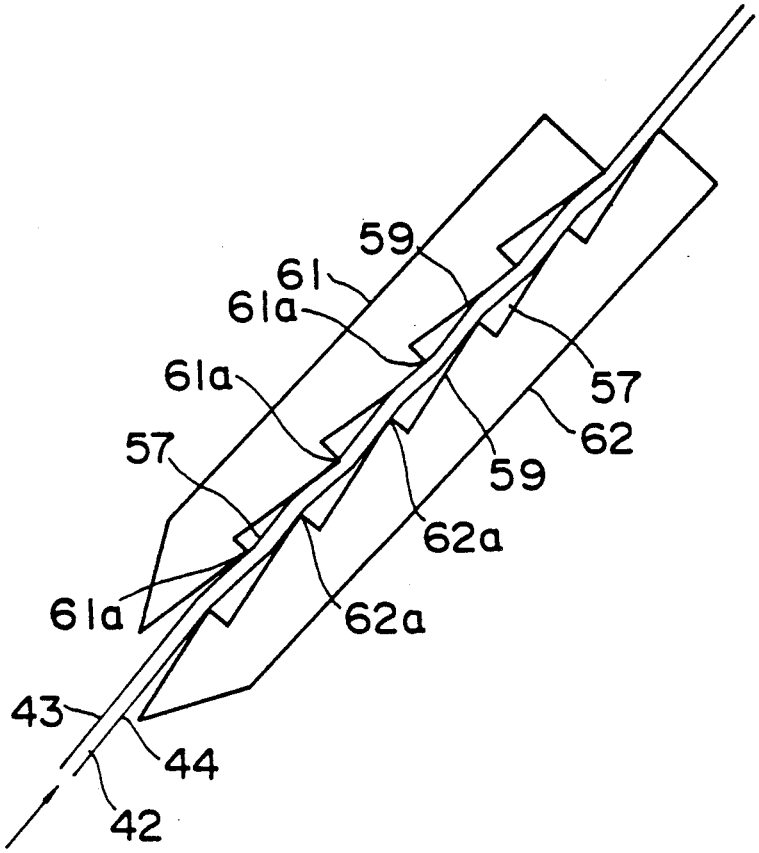
FIG. 3 is a fragmental sectional side view of a paper web forming apparatus in accordance with another embodiment of the invention, illustrating an essential part of the apparatus in an enlarged scale.
Figure 4:
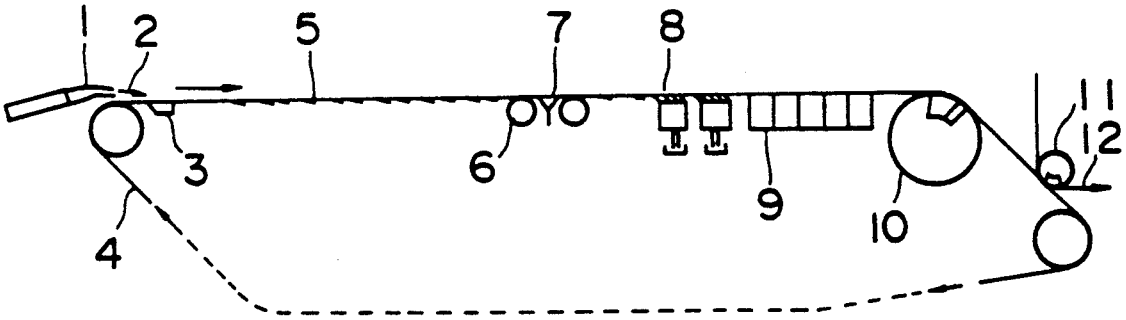
FIG. 4 (PRIOR ART)
FIG. 4 is a sectional side view of the conventional single wire type wire part.

FIGS. 1 to 3 schematically illustrate an embodiment of the invention, wherein FIG. 1 is a schematic side view of a wire part including formation improving zone according to the invention, FIG. 2 is a schematic side view of the formation improving zone in FIG. 1, shown in an enlarged scale and FIG. 3 is a fragmental schematic side view of a modified embodiment of the invention in which each side including a plurality of forming foil is designed in the integrated structure.

Referring to the drawing, raw material 42 injected from the head box 41 is introduced into the space as defined between two wires 43 and 44 and thereafter it passes through an initial dewatering zone 45 which comprises a forming board 33, a plurality of foils 35 having reduced dewatering function and a deflector 46 located opposite to the foils 35 for the purpose of scraping white water which is oozed out of the layer of raw material toward the opposite side relative to the foils 35 so as to allow raw material to assume the stable and uniform state between the two wires. Thus, raw material reaches the forming improving zone 47. When raw material has an very low consistency, it is preferable that it is dewatered to a certain acceptable level of consistency in the initial dewatering zone 45.

Figure 5:
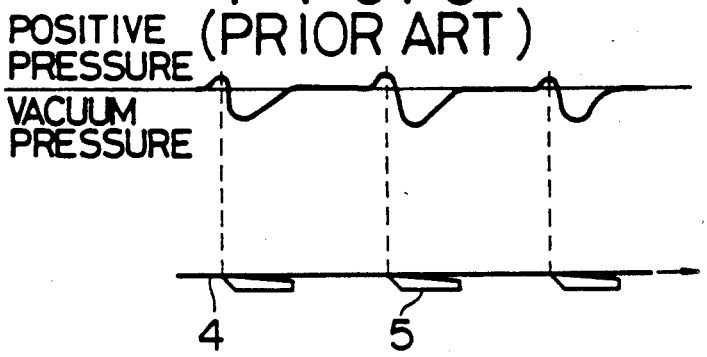
FIG. 5 (PRIOR ART)
FIG. 5 is a fragmental enlarged side view of the apparatus in FIG. 4, particularly illustrating change of pressure exerted on raw material by foils.
Figure 8:
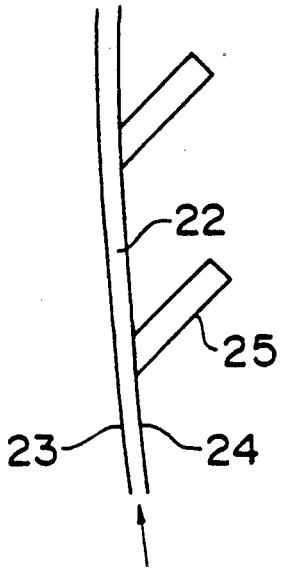
FIG. 8 (PRIOR ART)
FIG. 8 is a fragmental side view of the apparatus in FIG. 7, particularly illustrating the structure of an essential part of the apparatus in an enlarged scale.
Figure 6:
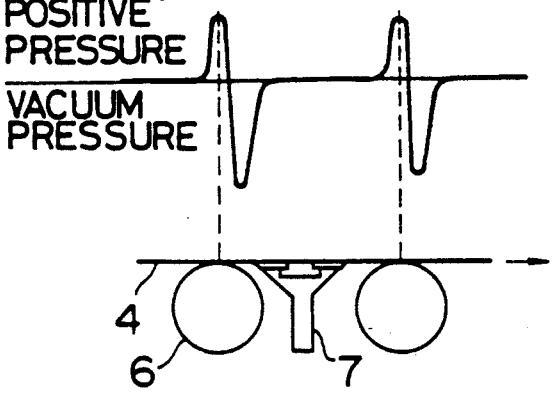
FIG. 6 (PRIOR ART)
FIG. 6 is a fragmental enlarged side view of the apparatus in FIG. 4, particularly illustrating change of pressure exerted on the raw material by the table rolls.
Figure 7:
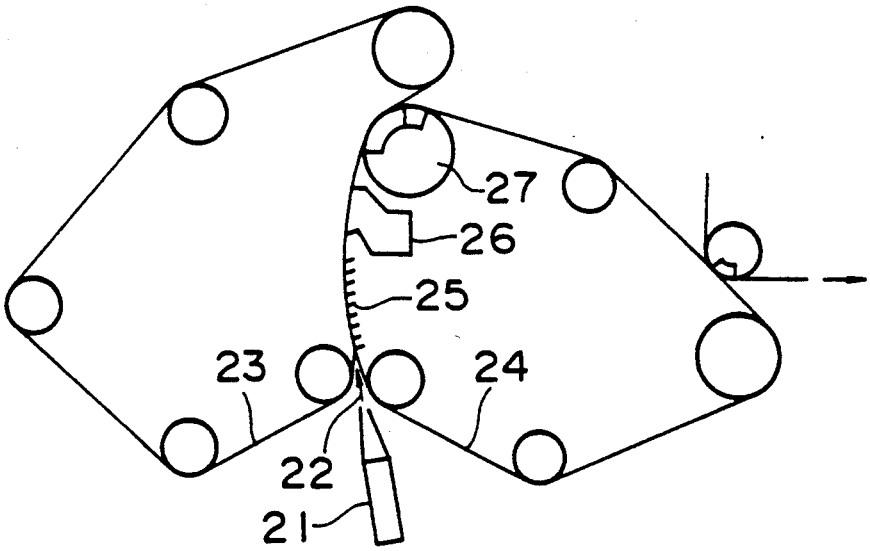
FIG. 7 (PRIOR ART)
FIG. 7 is a sectional side view of the conventional double wire type wire part.
Figure 9:
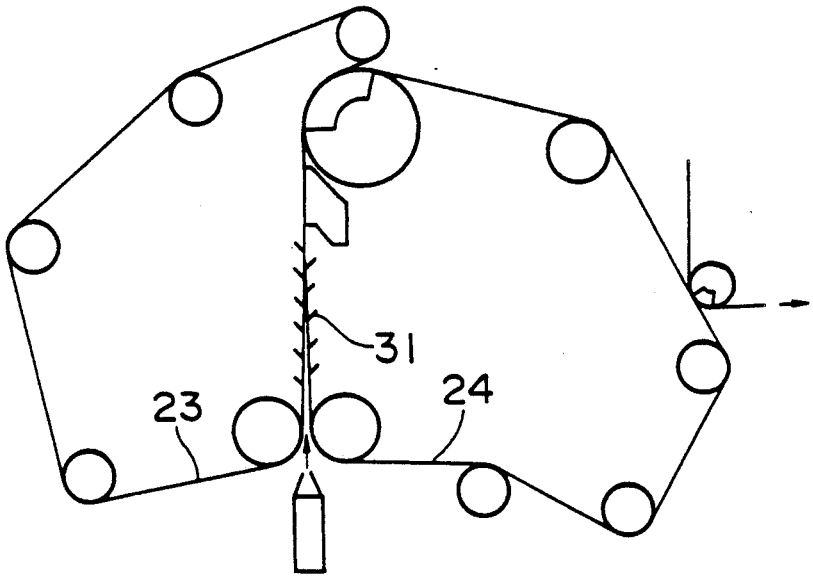
FIG. 9 (PRIOR ART)
FIG. 9 is a sectional side view of the conventional gap system double wire type wire part.
Figure 10:
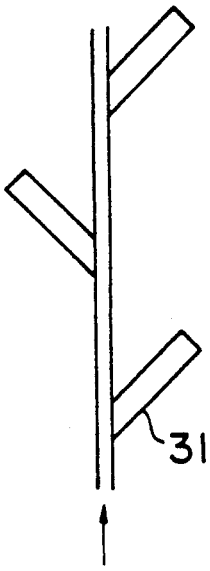
FIG. 10 (PRIOR ART)
FIG. 10 is a fragmental side view of the apparatus in FIG. 9, particularly illustrating the structure of an essential part of the apparatus in an enlarged scale.
Figure 11:
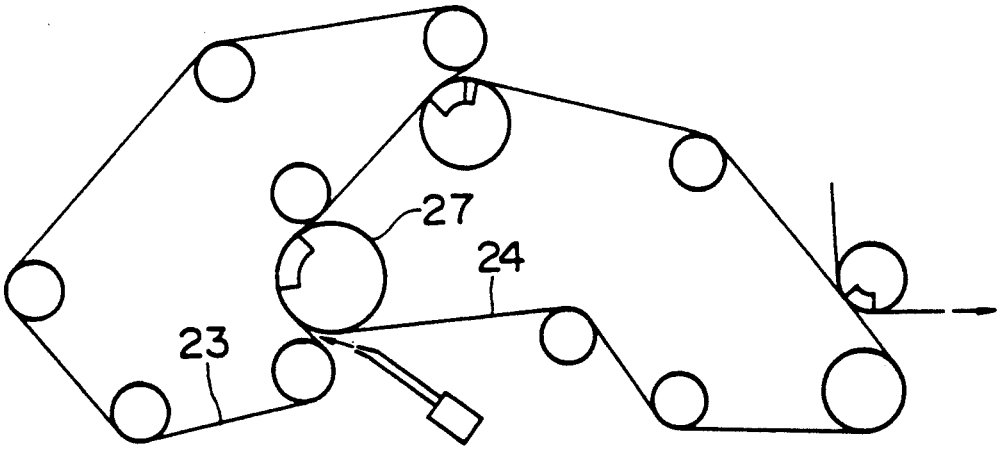
FIG. 11 (PRIOR ART)
FIG. 11 is a sectional side view of the conventional roll system double wire type wire part.

Specifically, the formation improving zone 47 is constituted by a plurality of formation foil 48 which serve as a series of wire supporting members in the both sides of wires. As is apparent from the drawing, the formation foil 48 are arranged at a predetermined inclination angle relative to the moving wires 43 on 44 in such a manner that their rear ends come in contact with the wires 43 on 44 to support the latter. Thus, a wedge-shaped space 57 having an apex at the contact point 60 is built in the area as defined between the formation foil 48 and each of the wires 43 and 44. Namely, this is the case where arrangement is so made in the reverse direction that the foremost ends of the conventional wire part components (excluding rolls) come in contact with the wires (see FIGS. 5, 8 and 10).

The reason why the foremost end of the conventional formation foil wire part component is adapted to come in contact with the wires is that white water oozed out from raw material through the adjacent wires under the effect of function and gravity of the preceding wire support component or the like means is scraped while inhibiting it from permeating into raw material again accompanied by adverse effect on mat formation, and moreover dewatering is achieved effectively. Must particular care is taken on the geometrical configuration of the foremost end part of the wire part component.

In the embodiment as illustrated in FIGS. 1 and 2 the formation foils 48 are alternately arranged on both sides but the present invention should not be limited only to such alternate arrangement as mentioned above. Namely it is possible to arrange alternately on every two or more formation foils on both the sides. Further, the present invention should not be limited to moving of the wires in the oblique direction. Alternatively, the wires may move in the vertical or horizontal directions. Further, the contour of lines of the wires in the formation improving zone 47 may be generally scribed in the circular shape.

After passing through the formation improving zone 47, raw material is dewatered in a dewatering section 49 quickly which is located behind the formation improving section 47 for the purpose of mat forming whereby fiber mat (wet web is formed quickly in the dewatering zone 49. This dewatering zone 49 comprises a deflector 50, a plurality of foil 51, a foil box 52, a suction box 53 and a suction couch roll 54. However, the present invention should not be limited only to the arrangement as mentioned above. Decision may be properly made in consideration of paper making conditions as to what components among the above-mentioned ones should be employed. It should be noted that raw material which has moved over the suction couch roll 54 assumes such a wet web having substantially the same consistency of about 20% as that in the conventional wire part and it is then transferred to a felt 56 under the effect of suction effected by means of a suction pickup roll 55.

FIG. 3 is a fragmental schematic side view of the paper web forming apparatus which is constructed in the different manner from the embodiment as illustrated in FIGS. 1 and 2. The apparatus includes wire supporting members 61 and 62 which are formed with a plurality of projections 61*a* and 62*a* adapted to support the wires 43 and 44 with raw material 42 interposed therebetween and a set of wedge-shaped spaces 57 is formed in the area as defined between each of the wire supporting members 61 and 62 and each of the wires 43 and 44 with an apex being located at each of the projections 61*a* and 62*a*.

Refering to FIGS. 1 and 2 again, raw material and two wires 43 and 44 which have moved to the formation improving zone 47 via the initial dewatering section 45 is first subjected to function of the first formation foil 48*a*. As will be well seen in FIG. 2, the formation foil 48*a* is pushed into raw material by a very short distance 58 relative to the wire line. Thus, raw material 42 is affected by pressure which is generated by the above-mentioned pushing-in and wire tension while it is clampled between the wires 43 and 44 whereby white water is oozed out of raw material 42, resulting in the wires 43 and 44 becoming wetted with white water (dewatering is achieved).

Once white water is oozed out of raw material on the formation foil side, the surface of the formation foil 48*a* becomes wetted with white water and at the same time the latter is forcibly caused to flow back toward raw material under the effect of the wedge-shaped space 57.

Thereafter, white water as identified by reference numeral 59 permeates through raw material with the aid of function of the formation foil until it is oozed out of raw material on the opposite wire surface (dewatering is achieved). Then, it moves further together with the wires 43 and 44.

Next, white water 59 is received in the wedge-shaped space as defined by the second formation foil 48*b* and it is then oozed out of raw material on the opposite wire surface in the same manner as in the area of the first formation foil. Then, raw material, white water and wires move toward the third formation foil 48*c*.

It should be noted that difference between the first formation foil and the second and other ones is such that pressure is generated in the slightly different manner when raw material moves past them. Namely, in the case of the first formation foil pressure increase is initiated just before the wires come in contact with the formation foil. On the other hand, in the case of the second and other formation foils pressure increase is initiated at time when the surface of the formation foil becomes wetted with white water having a certain thickness after it is oozed out of the wire surface by a preceding foil. This means that pressure increase is achieved at a comparatively slow rate with elongated working time and reduced shock. For the reason a volume of displacement of water increases but displacement of filler or the like material is inhibited under the effect of resistance developed by existence of fibers.

Since the formation improving zone 47 is constituted in the above-described manner, there is no fear of increasing consistency of the whole raw material containing white water therein due to flowing-out oozed water. Thus, fluidity of raw material is not lost and therefore the same function as in the second formation foil can be repeated by a required number of times.

On the other hand, raw material (fibrous material) clamped between both the wires 43 and 44 is caused to vibrate at a considerably high frequency under the influence of pressure and the flowing of white water which are generated by the formation foils 48. However but an extent of vibratory movement of raw material is limited by a close clearance between the adjacent wires which is defined by basis weight and a close clearance between the product and consistency of raw material.

A major part of white water flows in the direction at a substantially right angle relative to the wire surface but it is considered that there is existent a flow in the direction of movement of the wires as seen from the viewpoint of microscopical observation. Accordingly, dispersion of raw material is achieved in the direction of extension of the wire surface, that is, in such a direction that fibers expand in the direction of plane of paper. Since effect of dispersion achieved in that way increases accumulatively as a number of steps of movement increases, it is assured that raw material which is well dispersed in the direction of extension of plane and can not be obtained by means of any conventional wire part is prepared.

Thickness of raw material held between two wires and consistency of raw material pitch of formation foil, inclination angle and spacial volume of wedge-shaped space, depth of pushing-ing in of formation foil, wire tension and wire speed can be noted as factor which has an effect of function of dispersion in the formation improving zone. Obviously, each of the above-noted factors can be easily adjusted and determined in dependence on operative conditions of the apparatus.

Since formation of the paper with the aid of the conventional wire part is carried out in conjunction with dewatering as mentioned above, it is found that its effect is less recognizable and in some case it tends to have an adverse effect on fiber matt.

On the contrary, the apparatus of the invention is so operated that dispersion of raw material is repeatedly carried out while maintaining fluidity of the same, resulting in remarkably improved effect of dispersion assured. Thus, a sample produced by operating a testing machine with the apparatus of the invention mounted thereon exhibits the same or better formation compared with that of commercial fine paper which was made up by raw material having a consistency of lower than 1% (printing paper) when raw material held in the head box has a consistency of 1.4%. Even when raw material has a consistency higher than 3%, a sample produced in that way exhibits that residual flock has a very faint and soft feeling with excellent effect of dispersion recognized and therefor it does not have such a formation as is seen when fiber mat is teared in pieces with the conventional wire part for which raw material has an increased consistency. Naturally, this effect can be expected even in the case when raw material has a consistency lower than the above-mentioned one.

Further, since the apparatus of the invention is so constructed that water constituting a major part of raw material is caused to alternately move in the transverse direction at a right angle relative to the wire surface while it is exerted on both the sides of raw material which is held between two wires. This leads to an advantageous feature of the invention that a product in the form of paper has excellent uniformity in the distribution of short fiber and filler as seen in the direction of thickness of the product. Since fibers are distributed in the direction of extension of plane of paper in the apparatus of the invention, it is assured that thus produced paper has excellently high strength as seen in the direction of extension of plane of paper even when the apparatus is operated using raw material having high consistency. As a result, the apparatus of the invention is free from such a significant drawback due to extremely reduced paper strength as is seen with the conventional apparatus in which raw material having high consistency is used.

According to the invention operative function to be imparted to raw material is gradually transmitted to raw material by way of white water which is retained in the wedge-shaped space and thereafter it is exerted on the contact area of the rearend where the wires are supported. This leads to other advantageous feature of the invention that reduced shock is imparted to raw material for a long period of operative time. Further, when raw material dispersed in the formation improving zone is dewatered to predetermined consistency in the area located behind, there is no necessity for imparting a high intensity of pulse force to raw material for the purpose of improving formation and what is to be done is only dewater quickly. As a result, an improved yielding rate of raw material and filler is assured.

According to the invention white water oozed out of raw material into the wedge-shaped space is caused to enter the wire supporting area whereby it functions as lubricating oil. As a result, frictional resistance appearing between the wires and the wire supporting members and wearing of the latter due to friction can be reduced and a running life of the wires can be elongated remarkably. Since an amount of scattered white water can be reduced remarkably compaired with the conventional double wire system, mist ventilators are required very few and moreover white water can be easily treated. Thus, the apparatus of the invention can be operated under clean atmosphere.

While the present invention has been described above only with respect to a few preferred embodiments thereof, it should of course be understood that it should not be limited only to them but various changes or modifications may be made in any acceptable manner without departure from the spirit and scope of the invention as defined by the appended claims.

What is claimed is:

1. A paper web forming apparatus comprising:

a pair of sheets of wires which are substantially parallel to each other and which define a wire line moving together with stock held therebetween in a substantially spaced relationship; and a plurality of wire supporting members for supporting said wires, said wire supporting members each having a front end and a rear end defining an inner surface facing said wires, said inner surface being substantially free of holes, bumps or dips, said wire supporting members contacting said wires at said rear end thereof at an angle with said wires forming wedge-shaped spaces between said inner surface of said support members and said wires, said wires otherwise being free of contact with said supporting members, said wedge-shaped spaces narrowing in the direction of the movement of said wires forming an apex where said support members contact said wires;

said wedge-shaped spaces formed by said inner surface of said support members and said wires receiving white water oozed from said stock and pushing said white water back into said stock;

said wire supporting members being alternately disposed on both sides of said sheets of wires and having said rear ends pushed in for a distance relative to said wire line, said distance being a distance such that said rear ends are pushed toward the wires such that said members alternately push or direct said white water oozed into said wedge-shaped spaces back into said stock, said supporting members each having a side downstream of the wire contacting rear ends thereof which side is generally perpendicular to the pair of sheets of wires, whereby, along with movement of said sheets of said wires, said stock held therebetween is compressed by said support members and by wire tension so as to repeatedly ooze said white water to wet the wires, said white water thus oozed being pushed back into said stock by action of said wedge-shaped spaces thereby obtaining a high quality formation web by wavering said stock held between said sheets of wires.

2. A paper web forming apparatus comprising:

a pair of substantially parallel wires moving together with stock held therebetween; and a pair of wire supporting members each having a plurality of projections adapted to support said wires and arranged to be pushed in against said wires, said wire supporting members each forming a plurality of wedge-shaped recesses defined as areas between said wire supporting members and said wires such that the pair of wires only engage the wire supporting members at the projections thereof and said pair of wires move along a zigzag path, each projection being defined by an inclined first side of the respective wire supporting member facing the pair of wires and forming a portion of the respective wedge-shaped recess, and an upstream second side of the respective wire supporting member generally perpendicular to the pair of wires;

wherein each of said defined wedge-shaped recesses has an apex pointing toward a subsequent projection of said support member, and wherein said wedge-shaped recesses of one wire support member are alternately disposed with respect to said wedge-shaped recesses of said other wire support member.

* * * * *